US007763787B2

(12) United States Patent
Jean

(10) Patent No.: US 7,763,787 B2
(45) Date of Patent: Jul. 27, 2010

(54) WIND INSTRUMENT LIGATURE

(76) Inventor: Marc Jean, 234, Ste-Elizabeth, Longueuil, Quebec (CA) J4H 1J5

( * ) Notice: Subject to any disclaimer, the term of this patent is extended or adjusted under 35 U.S.C. 154(b) by 0 days.

(21) Appl. No.: 12/361,672

(22) Filed: Jan. 29, 2009

(65) Prior Publication Data

US 2009/0193956 A1 Aug. 6, 2009

Related U.S. Application Data

(60) Provisional application No. 61/025,357, filed on Feb. 1, 2008.

(51) Int. Cl.
*G10D 7/00* (2006.01)

(52) U.S. Cl. ..... 84/380 R

(58) Field of Classification Search ..... 84/383 A, 84/383 R, 380 R

See application file for complete search history.

(56) References Cited

U.S. PATENT DOCUMENTS 5,000,073 A 3/1991 Hite
5,398,582 A 3/1995 Smith
D367,074 S 2/1996 Gholson
5,998,715 A 12/1999 Rovner
6,020,545 A 2/2000 Consoli
6,118,060 A 9/2000 Van Doren

FOREIGN PATENT DOCUMENTS

WO WO2004109653 * 12/2004

* cited by examiner

*Primary Examiner*—Kimberly R Lockett

(57) ABSTRACT

A musical instrument ligature using at least one stalk which act as the contact points between the ligature and the reed when it is clamped onto the mouthpiece of a wind instrument. The stalks are preferably positioned so as to be non-parallel to each other thereby effecting varying contact points between the ligature and the reed. The ligature is slid over the mouthpiece of an instrument and tightened as desired using a set of butterfly screws and nuts positioned at the ends of the metallic band forming the ligature.

7 Claims, 4 Drawing Sheets

10
12
12a
12b
13
14
16
17
19
21
40
9

WIND INSTRUMENT LIGATURE

This application claims priority based on provisional application 61/025,357 filed Feb. 1, 2008.

FIELD OF THE INVENTION

The present invention relates generally to a ligature for musical instruments but more specifically to an improved ligature which enhances reed vibrations and sound quality.

BACKGROUND OF THE INVENTION

A musical instrument ligature is a device which holds a reed on to the mouthpiece of woodwind instruments such as the saxophone and clarinet. Traditionally the reeds were bound to the mouthpiece by a cord, hence the term ligature which means the act of tying or binding. Ligatures today are most commonly made out of metal, such as brass, and can be plated in nickel, silver, gold, rhodium, etc.

There are a number of ligature designs each improving on the way the reed is held and comes into contact with the ligature. The contact between the reed and the ligature reflects the tonal qualities of the instrument. The more tightly the reed is held or screwed down to the mouthpiece, the more dampened the sound.

Modern day ligatures are typically made of metal and are of a screw type where the metal band holds the reed in place to the mouth piece with several design variations which play with the contact between the reed and the ligature to get the best results.

There are a few ligatures available today constructed totally in wood instead of metal working on the same principle of holding the reed pressed to the mouthpiece as in previous versions.

The present invention specifically addresses minimizing the contact between the ligature and the reed to a minimum never before achieved, using a combination of wood and metal.

The invention provides for a metal ligature using one, two, or more wooden stalks which act as the contact points between the ligature and the reed thereby enhancing reed vibration and tonal quality to the maximum.

SUMMARY OF THE INVENTION

In view of the foregoing disadvantages inherent in the known devices now present in the prior art, the present invention, which will be described subsequently in greater detail, is to provide objects and advantages which are:

To provide for a ligature incorporating at least one stalk serving as sole contact points between the reed and the ligature's band holding it to the mouthpiece. This results in a cleaner, more centered sound with enhanced ease of hitting the notes.

Another advantage of the invention is that, when using two or more stalks, the stalks are angled, so that by sliding them inside the band of the ligature, the contact points between the reed and the stalks are modified to effect desired variations in tonality.

To attain these ends, the present invention generally comprises a band having an inner wall and an outer wall. The band being configured and sized to encircle the mouthpiece. The band has at least one fastening means to releasably and frictionally attach the ligature to the mouthpiece. At least one stalk inserted between the band and the mouthpiece.

In a preferred embodiment, the band has at least one indent on the inner wall.

The stalk is glued to the inside wall, preferably into the indent.

Two stalks are glued on the inner wall and aligned in a non parallel fashion.

Two indents located on the inner wall are aligned in a non parallel fashion so as to properly position one stalk in each indent so that both stalks are not parallel.

The stalks have a width of between 0.080 to 0.120 thousandth of an inch. The relative angle between two stalks is 3 degrees.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matte which contains illustrated preferred embodiments of the invention.

DETAILED DESCRIPTION OF THE PREFERRED EMBODIMENT

Figure 2:
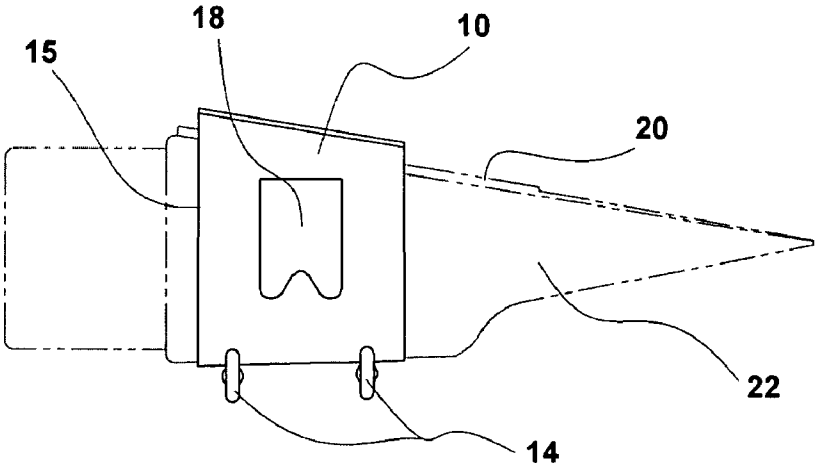
FIG. 2 Side view of ligature on mouthpiece.
Figure 3:
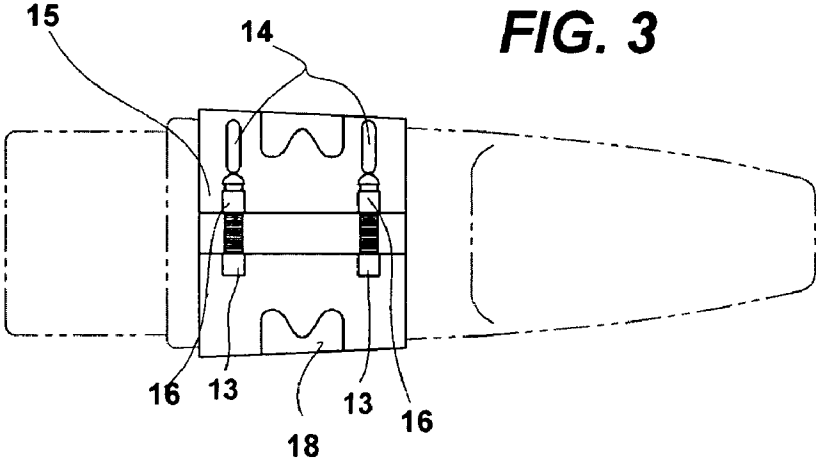
FIG. 3 Top view of ligature on mouthpiece.
Figure 1:
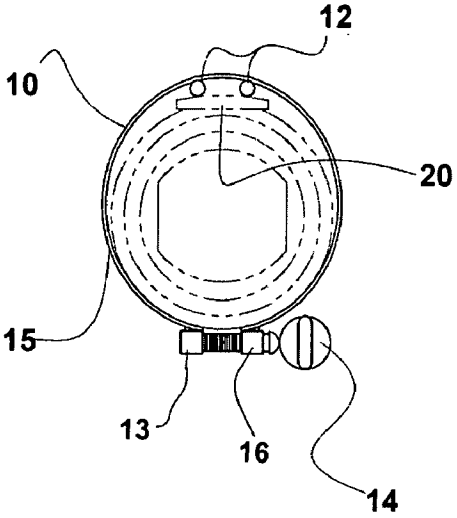
FIG. 1 Front view of ligature.
Figure 6:
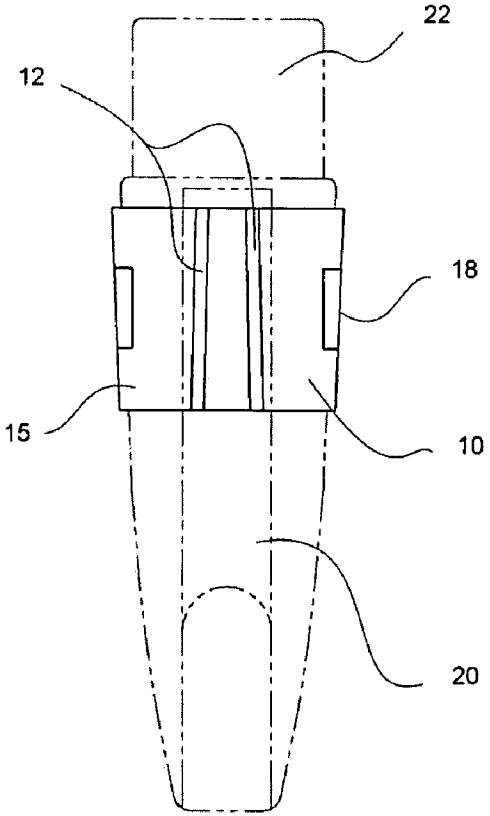
FIG. 6 Bottom view of ligature on mouthpiece.
Figure 5:
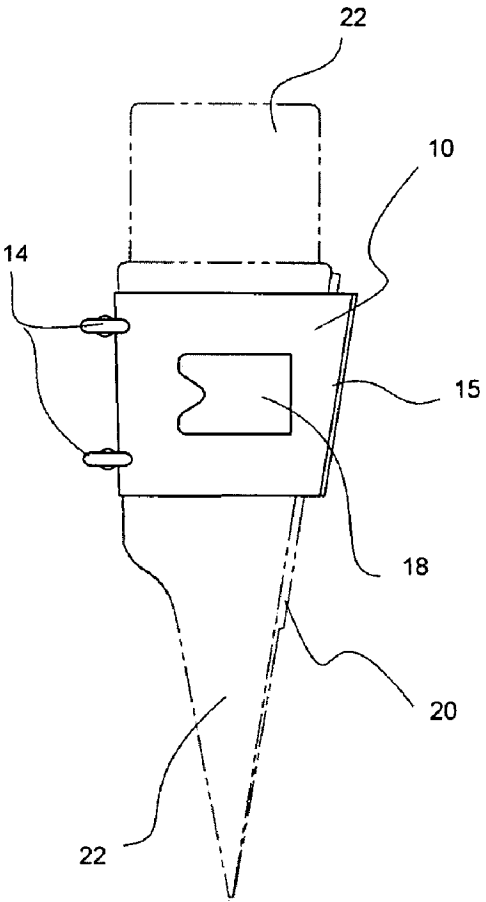
FIG. 5 Side view of ligature on mouthpiece.
Figure 4:
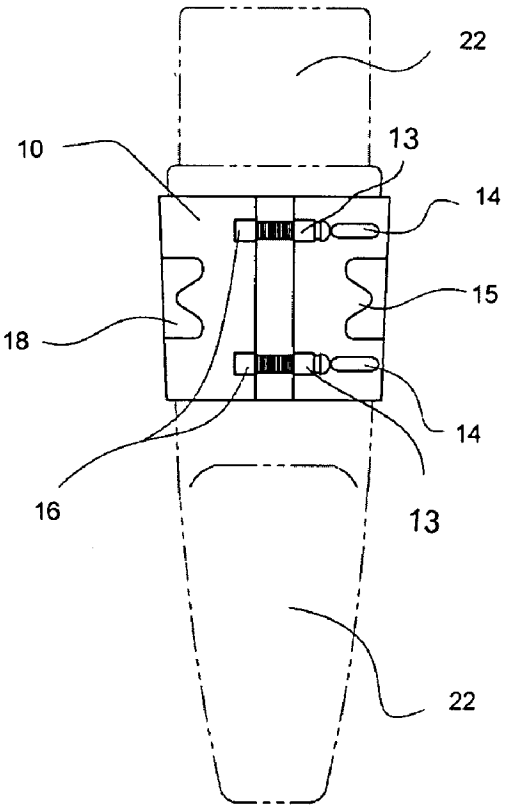
FIG. 4 Top view of ligature on mouthpiece.

A musical instrument ligature (10) for use in holding a reed (20) to the mouthpiece (22) of a wind instrument (not shown) has a band (15) configured and sized to encircle the mouthpiece (22). and at least one fastening means (14) to releasably and frictionally attach the ligature (10) to the mouthpiece (22). The fastening means (14) is adjustable by way of a threaded bolt (9), threading through a smooth bore standard (16) and a threaded standard (13) so as to allow the diameter of the band (15) to be decreased or increased so as to tighten or loosen the ligature (10), around the mouthpiece as is known in the art.

In a preferred embodiment and as is commonly known in the art, the ligature is made out of metal and there are openings (18) on each side of the band (15).

The band (15) has an inner wall (19) and an outer wall (21) at least one indent (17) is stamped or carved into the inner wall (19) and which may or may not protrude on the outer wall (21). This indent (17) creates a channel into which a stalk (12) is placed. The stalk can be held within the channel by way of an adhesive means. In a preferred embodiment, there are two stalks (17). There could also be more than two stalks (17). Also, the indent (17) is not absolutely essential but is preferable so as to properly position the stalk (17).

Figures 7A, 7B, 7C:
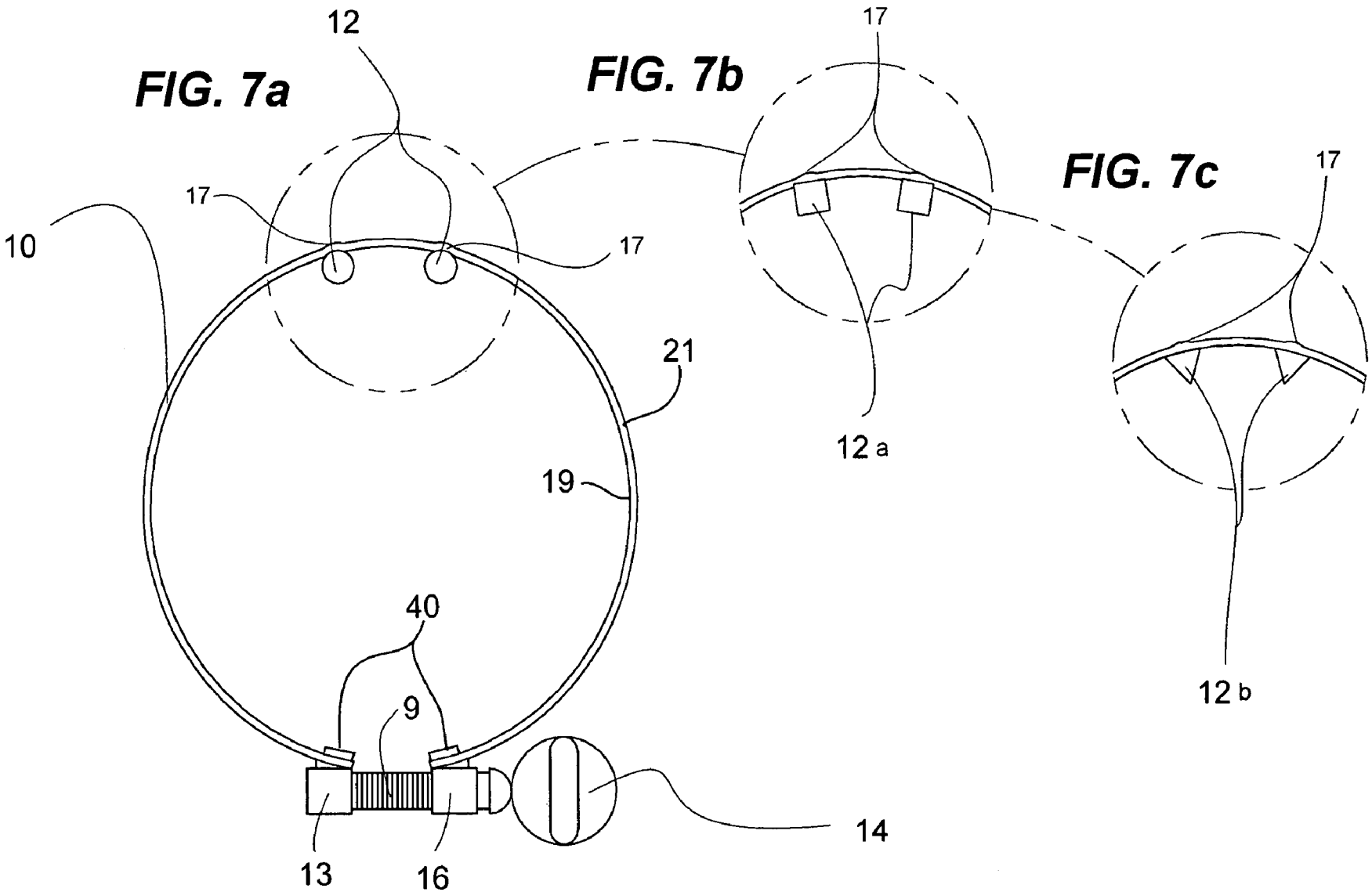
FIGS. 7*a-c* Front views of ligature with varied shaped stalks.

The stalk (12) can be built in any of a variety of shapes, as seen in FIGS. 7*a-c* (12, 12*a*, 12*b*). The stalk (12) acts as the sole contact point between the band (15) and the reed (20), thereby minimizing contact and allowing the reed (20) more freedom to vibrate. The stalk (12) can be made out of a variety of materials including but not limited to ceramic or wood. The width of the stalk is optimum within the range of 0.080 to 0.120 thousandth of an inch. The relative angle between two stalks is best at 3 degrees. Since sound quality is very subjective, these are mere suggestions, and the actual angles and sizes of the stalks can vary greatly according to the type of sounds desired by any given musician. For practical reasons, a piece of soft material (40) such as cork, for example, is placed on the inner wall (19), just opposite the threaded standard (13) and the smooth bore standard (16) so as to eliminate the possibility of scuff marks on the mouthpiece (22).

Figure 8A:
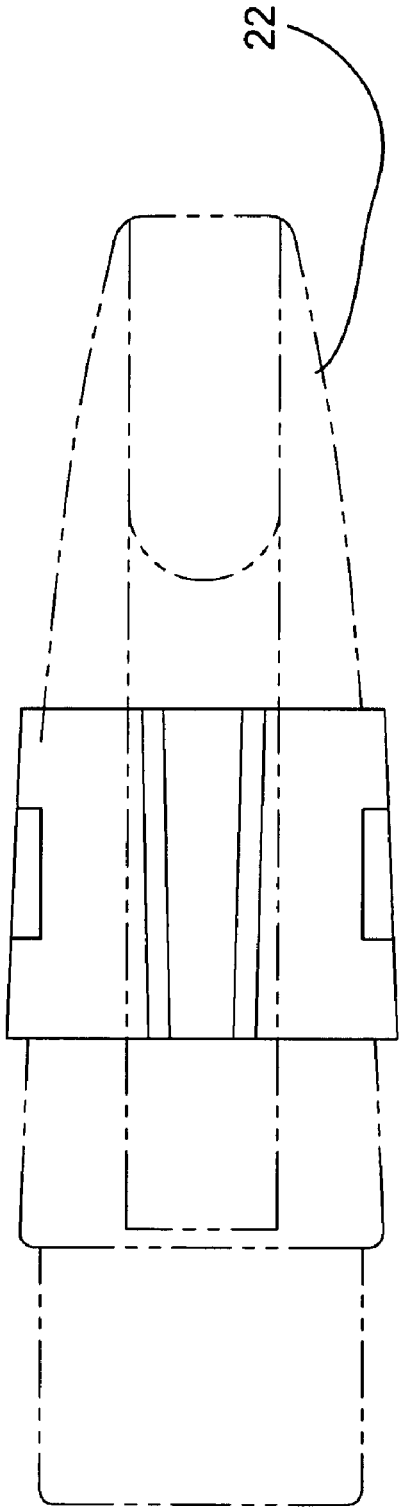
FIGS. 8*a-b* Bottom views showing the ligature repositioning on the mouthpiece.
Figure 8B:
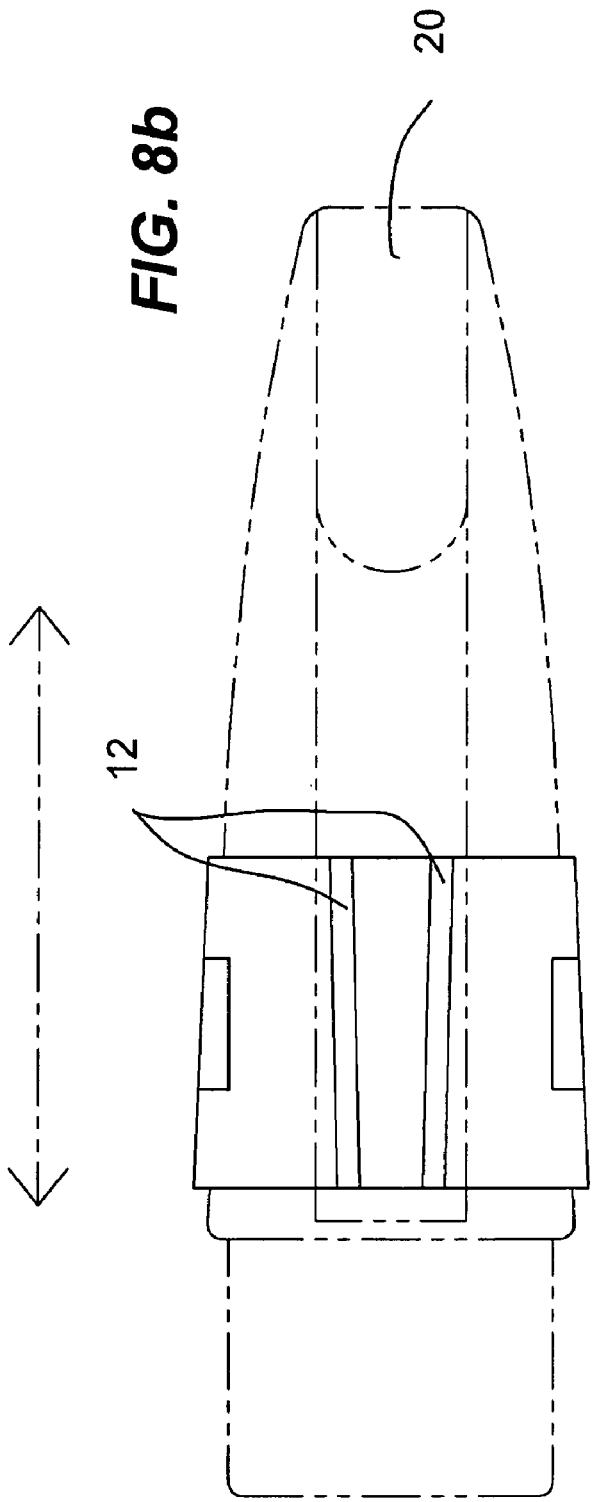

Although the prior art does show various means of isolating the ligature (10) from the reed (20). What the prior art fails to teach is the angle between the stalks (12) which has an impact on how the instrument sounds because it allows, by simply sliding the ligature along the mouthpiece, as seen in FIG. 8, which will press the reed (20) at specific contact points that are towards the sides rather than more towards the center can affect the way the reed vibrates.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A musical instrument ligature for use in holding a reed to the mouthpiece of a wind instrument comprising:

a band having an inner wall and an outer wall;

the band being configured and sized to encircle the mouthpiece;

the band has at least one fastening means to releasably and frictionally attach the ligature to the mouthpiece;

at least two stalks inserted between the band and the mouthpiece wherein said at least two stalks are aligned in a non parallel fashion relative to one another.

2. A musical instrument ligature as in claim 1 wherein:

the band has at least two indents on the inner wall.

3. A musical instrument ligature as in claim 1 wherein:

the at least two stalks are glued to the inside wall.

4. A musical instrument ligature as in claim 2 wherein:

the at least two stalks are (stalk is) glued into the indent.

5. A musical instrument ligature as in claim wherein:

the two indents located on the inner wall are aligned in a non parallel fashion so as to properly position one stalk in each indent so that both stalks are not parallel.

6. A musical instrument ligature as in claim 1 wherein:

the stalks have a width of between 0.080 to 0.120 thousandth of an inch.

7. A musical instrument ligature as in claim 1 wherein:

The (relative angle between) two stalks are aligned such that the an between them is 3 degrees.

* * * * *